United States Patent [19]

Golten

[11] 3,958,380

[45] May 25, 1976

[54] BUILDING COMPONENTS

[75] Inventor: Desider Golten, Hengoed, Wales

[73] Assignee: BKL Alloys Limited, Birmingham, England

[22] Filed: Mar. 6, 1975

[21] Appl. No.: 555,935

[52] U.S. Cl. ..... 52/208; 49/504
[51] Int. Cl.[2] ..... E06B 1/00; E06B 3/00
[58] Field of Search ..... 52/204–214; 49/504

[56] References Cited

UNITED STATES PATENTS

| | | | |
|---|---|---|---|
| 1,840,221 | 1/1932 | Bridges | 52/212 |
| 2,660,272 | 11/1953 | Walterman et al. | 49/504 |
| 2,687,194 | 8/1954 | Kelly | 49/504 |
| 3,503,168 | 3/1970 | Eggert | 52/208 |
| 3,835,586 | 9/1974 | Gates et al. | 49/504 |

FOREIGN PATENTS OR APPLICATIONS

| | | | |
|---|---|---|---|
| 1,318,724 | 1/1963 | France | 49/504 |

*Primary Examiner*—J. Karl Bell
*Attorney, Agent, or Firm*—Friedman & Goodman

[57] ABSTRACT

A sub-frame for supporting a window in a cavity wall, the sub-frame having a lintel, a sill and jambs all rigidly interconnected with the jambs inset from the ends of the lintel and sill, each of the lintel, sill and jambs having a U-section part in the form of a rectangular channel, the sides of the channels providing inner and outer abutment surfaces around the aperture in the sub-frame which receives the window. The lintel has an inner part which supports, over the sub-frame, an inner skin of bricks of the cavity wall, an outer part which supports an outer skin of bricks of the wall and an inclined part which extends across the cavity and which joins the inner and outer parts. In use, a window is received in the aperture and has a flange which overlaps and is sealed to the outer abutment surfaces of the sub-frame.

8 Claims, 7 Drawing Figures

BUILDING COMPONENTS

BACKGROUND OF THE INVENTION

1. Field of the Invention

This invention relates to sub-frames for use in the installation of windows in buildings.

2. Description of the Prior Art

In the installation of a window in a building a sub-frame is secured in an opening in a wall of the building to provide a mounting for a glazed window which is either fixed or hinged to the sub-frame. The sub-frame presents a rectangular opening for the window and comprises two spaced vertical members constituting jambs and two spaced horizontal members the lower one of which constitutes a sill.

The invention is primarily concerned with sub-frames for use in buildings having cavity walls comprising an inner skin and an outer skin with a cavity between them. Conventionally, a load bearing lintel, separate from the sub-frame is incorporated in the wall above the opening.

The present invention has for its object to simplify the installation of windows in buildings by the provision of an improved form of sub-frame.

Summary of the Invention

According to the invention we provide a sub-frame for supporting a window in a building and providing a rectangular aperture to receive the window, the aperture being surrounded by parts of a load bearing lintel, a sill and parallel jambs extending between and spaced inwardly from the ends of, the lintel and sill, said parts being generally U-shaped in section in planes perpendicular to the general plane of the window to be received in the aperture, the bases of the U-sections of the parts defining the edges of the aperture and the limbs of the U-sections providing inner and outer abutment surfaces extending away from the centre of the aperture around the whole of the periphery thereof, the lintel, sill and jambs being rigidly interconnected.

In this specification, and in the claims, when we refer to "inner" and "outer" we are referring to parts and directions on the sub-frame with reference to the inner and outer surfaces of an external wall of a building in which the sub-frames would be installed when in use. Thus, for example, if we refer to the inner abutment surface we mean the surface facing someone inside the building and when we refer to the external abutment surface we mean the surface facing someone outside the building. Similarly, when we refer to "upper" and "lower" and "upwardly" and "downwardly" we refer to directions and parts of the sub-frame as it would appear in situ in a wall with the lintel at the top of the sub-frame and the sill at the bottom and the jambs extending vertically between the lintel and the sill.

As will be described below, by providing the U-section parts on the lintel, sill and jambs, the installation of a window in the aperture is facilitated because the window can be provided with an outer flange which overlies the outer abutment surfaces, the overlap allowing the combination of window and sub-frame to be weather-tight in spite of inevitable size tolerances of the sub-frame and the window. If it was necessary for the window to fit accurately within the aperture then these tolerances would have to be held to very small values and even so it would probably be necessary to fill the clearance between the window and the sub-frame with some form of sealing compound. Although the outer flange on the window will be sealed to the outer abutment surface normally with some sealing compound it will be appreciated that the dimensions of the window and sub-frame are not as critical as they would be were the window to fit directly within the aperture.

A further advantage of the invention is that by incorporating a lintel in the sub-frame, the need to build a separate lintel into a wall above the opening therein in which the sub-frame is disposed, is eliminated. Moreover, since the sub-frame is a prefabricated rigid structure it can be formed very accurately and can therefore be used as a reference or guide for the building of the wall around the sub-frame. Thus, for example, in the installation of a window sub-frame in a brick wall, when the wall has been built up to the required level of the window sill, the sub-frame is positioned on the wall, the wall is built up with reference to the jambs to the level of the lintel and then building of the wall is continued above the sub-frame with reference to the lintel, so that the wall is formed accurately around the sub-frame.

Preferably the U-sections of said parts are in the form of rectangular channels so that the inner and outer abutment surfaces are vertical when the sub-frame is in position and the bases of the channel are horizontal on the lintel and sill and vertical on the jambs.

Preferably, the jambs have a sectional shape such as in addition to the channel section part each jamb has a first flange parallel to the base of the channel and extending from the edge of one side of the channel remote from the base and a second flange extending from the outer side of the channel remote from the base and at an obtuse included angle with the inner surface of said other side. When the sub-frame is in position, the first flange of each jamb lies alongside the vertical face of the opening in the inner skin. The second flange of each jamb lies within the cavity between the inner and outer skins and is adjacent to the outer skin and provides a barrier for water which may enter the cavity or pass through the outer skin and directs the water so that it flows down the inclined flange into the cavity.

Preferably, the sill has, adjacent the inner abutment surface, a gutter to receive condensation from a window mounted in the sub-frame. The gutter may have holes in it to allow water to pass into the cavity and/or the ends of the gutter may open into the cavity.

Preferably, the lintel has an inner part adapted to support the inner skin of bricks over the sub-frame and an outer part adapted to support the outer skin of bricks over the sub-frame, the inner part being spaced upwardly from the outer part and joined thereto by an inclined part which extends across the cavity. The inclined part again deflects water which may pass through the outer skin so that it drips into the cavity. The upper part may, for example, be spaced above the lower part by a distance equal to the height of two courses of bricks.

In one form of lintel, the inner and outer inclined parts are provided by a Z-shaped element which also provides a flange depending from the inner edge of the inner part and the lintel includes a second element extending between the lower edge of the flange and the outer part and this second element also provides the U-section part on the lintel.

In another form of lintel, the inner and outer inclined parts are again provided by a Z-shaped element which also provides a flange depending from the inner edge of the inner part but the Z-section element also provides, adjacent the inner edge of the outer part, the U-section part of the lintel.

In this latter construction of lintel, a plurality of spaced second elements may extend between the lower end of the depending flange and the lower edge of the inclined part. The extremities of these second elements may pass through slots in the depending flange and inclined part and the extremities of the second elements may have been bent so as to lie parallel to the parts through which they pass to prevent spreading of the parts under load. The second elements may be provided with hooks to receive wire mesh or expanded metal which provides an anchor for plastering within the aperture in the inner skin.

The invention also provides, in combination with a sub-frame as described above, a window which is received within the aperture in the sub-frame and has a flange which overlaps and is sealed to, the outer abutment surface of the lintel, sill and jambs. The window may be held in position by lugs which engage a part of the window within the aperture and also the inner abutment surfaces. A sealing strip may be provided to cover the lugs and also the inner surface of the window and the inner abutment surfaces.

BRIEF DESCRIPTION OF THE DRAWINGS

The invention will now be described in detail by way of example with reference to the accompanying drawings in which.

DESCRIPTION OF THE PREFERRED EMBODIMENTS

Figure 1:
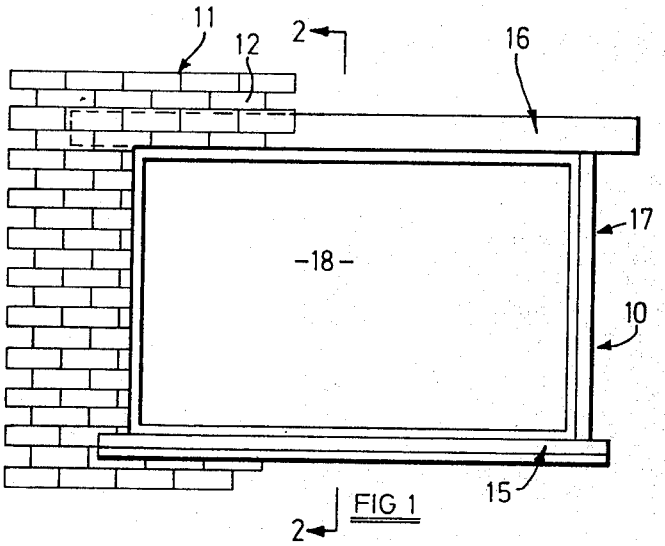
FIG. 1 is an elevation of a sub-frame embodying the invention showing, on one side, its relationship to the surrounding brickwork.
Figure 2:
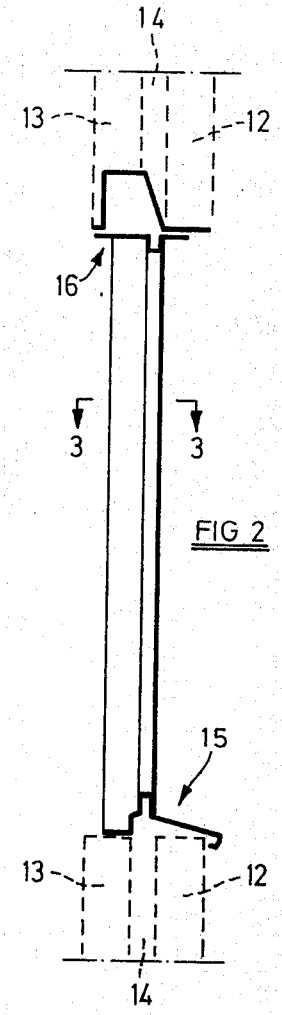
FIG. 2 is a section on the line 2—2 of FIG. 1 showing the brickwork in dotted lines.
Figure 3:
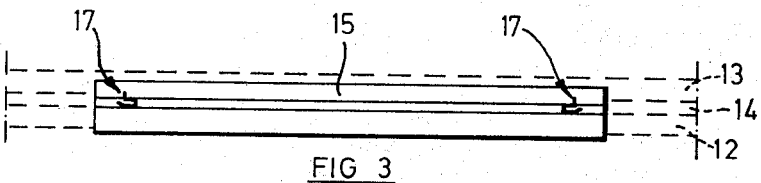
FIG. 3 is a section through the sub-frame on the line 3—3 of FIG. 2 again showing the brickwork in dotted lines.

Referring first to FIGS. 1 to 3, a sub-frame is indicated generally at 10 and is received in a cavity wall indicated generally at 11, the wall having an outer skin of bricks 12 and an inner skin of bricks 13, the skins being separated by a cavity 14. The sub-frame comprises a sill indicated generally at 15, a lintel indicated generally at 16 and a pair of parallel jambs indicated generally at 17. It will be noted from FIGS. 1 and 3 that the jambs 17 are parallel and are inset from the ends of the sill 15 and the ends of the lintel 16. The lintel, sill and jambs are preferably formed of sheet metal, for example mild steel of appropriate guage, which has been galvanized. It will be noted from FIG. 1 that the parts of the lintel and the sill which extend beyond the jambs are incorporated in the brickwork. The sub-frame defines a rectangular aperture 18 in which is received a window as will now be described in detail with reference to FIGS. 4 and 5.

Figure 4:
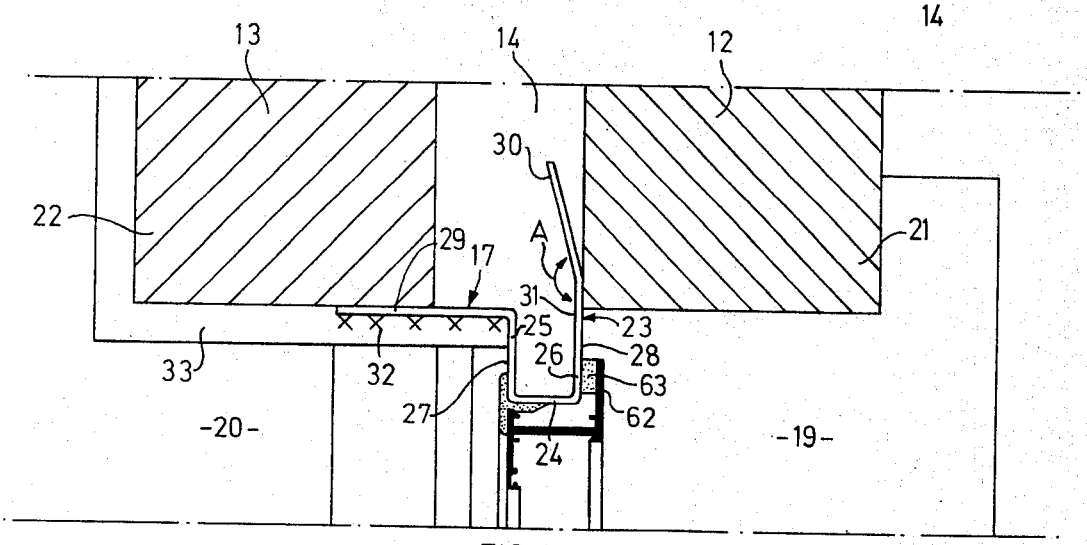
FIG. 4 is a horizontal cross-section, on a greater scale showing how a jamb of the sub-frame fits into the cavity in the cavity wall and also showing how a window engages with the jamb of the sub-frame.

Referring first to FIG. 4, it will be seen that the sub-frame is located in an aperture 19 in the outer brick skin 12 and an aperture 20 in the inner brick skin 13. The end portion of a brick at the vertical edge of the aperture 19 is indicated at 21 and the end portion of a brick at the vertical edge of the aperture 20 is indicated at 22. Both jambs 17 are identical and, referring to FIG. 4, the jamb comprises a U-section portion 23 which has a base 24, an inner side 25 and an outer side 26. The inner surface of the inner side 25 provides an inner abutment surface 27 and the outer surface of the outer side 26 provides an outer abutment surface 28. The jamb also includes a first flange 29 which is parallel to the base 24 and which lies alongside the end of the brick portion 22. There is also a second flange 30 which extends from the outer side 26 remote from the base 24 and the included angle A between the flange 30 and the inner surface of the outer side 26 is obtuse. It will be seen that the flange 30 is within the cavity 14 and acts as a moisture barrier so that any moisture passing through the outer skin 12 or between the outer side 26 of the channel and the outer skin 12 is allows to run down the flange 30 into the cavity 14. The flange 29 carries mesh or expanded metal 32 which may be welded to the flange and provides an anchor for a layer of plaster 33 which covers the inner surface of the inner skin 13 and the exposed surfaces of the inner skin 13 surrounding the aperture 20. It will be noted, from FIG. 4, that the jamb acts as a cavity closer and that therefore no separate cavity closer is required.

Figure 5:
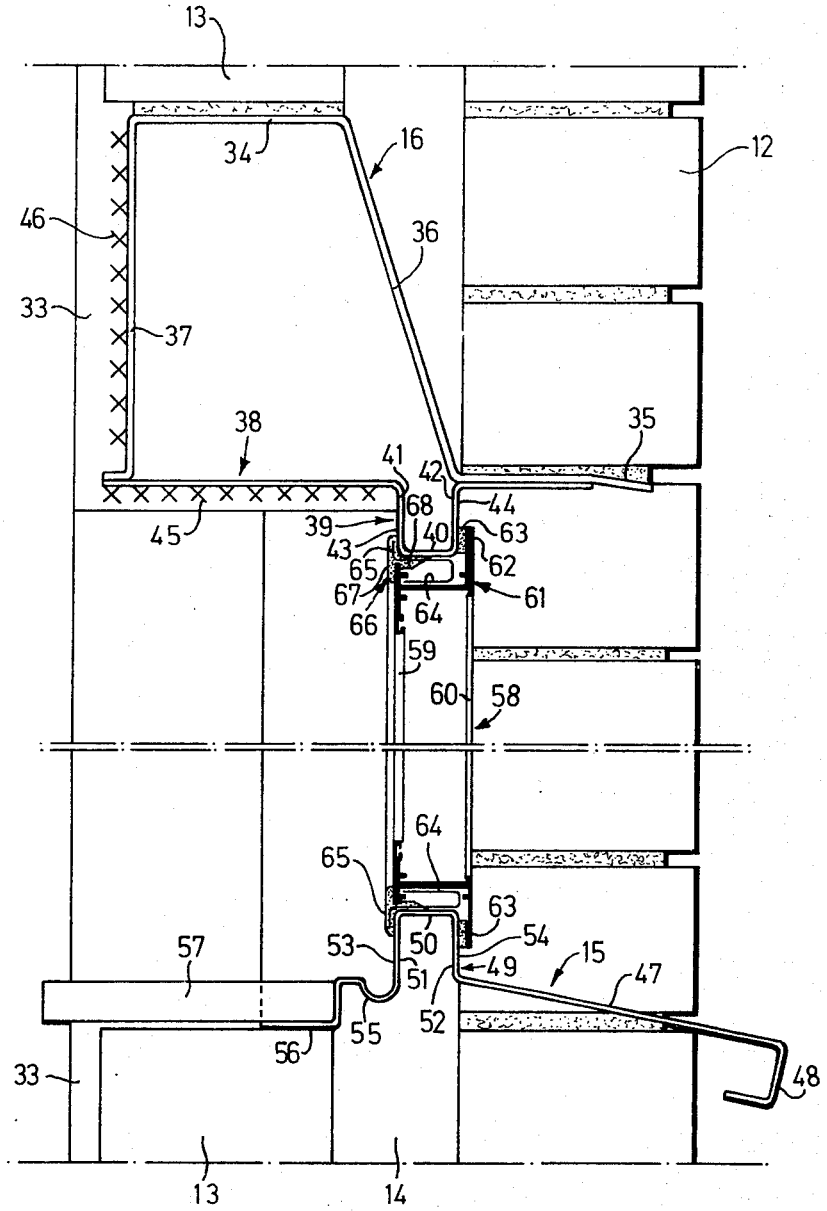
FIG. 5 is a vertical section similar to FIG. 2 but on an enlarged scale and showing a window received in the sub-frame.

Before describing how a window fits into the sub-frame we will describe the construction of the lintel and the sill with reference to FIG. 5. Referring to this figure, the lintel 16 has an inner part 34 which supports the inner skin of bricks 13 above the sub-frame and an outer part 35 which supports the outer skin of bricks 12 above the sub-frame. The parts 34 and 35 are joined by an inclined part 36. The parts 34, 35 and 36 are provided by a single Z-shaped element of sheet metal and this also provides a flange 37 which depends from the inner edge of the upper part 34. A second element indicated generally at 38 extends between the lower end of the flange 37 and the outer part 35. The second element 38 is welded in position. The second element 38 provides a U-section part 39 of the lintel. This U-section part comprises a base 40 and inner and outer sides 41 and 42. The inner surface 43 of the inner side provides an inner abutment surface and the outer surface 44 of the outer side 42 provides an outer abutment surface. Wire mesh or expanded metal indicated at 45 is welded or otherwise fixed to the second element 38 and similar mesh or expanded metal 46 is welded or connected to the flange 37 and this mesh or expanded metal provides an anchor for the layer 33 of plaster referred to above.

Referring now to the sill 15, this comprises an outer sill part 47 which is inclined downwardly and outwardly and has a retroverted end portion 48 standing proud of the outer brick skin 12 so that water which impinges on the outer sill part 47 will move outwardly clear of the skin 12 and drip off the end 48 in a position clear of the skin 12. The sill has a U-section part indicated at 49 and this has a base 50, an inner side 51 and an outer side 52. An inner abutment surface 53 is provided by the inner surface of the inner side 51 and an outer abutment surface 54 is provided by the outer surface of the outer side 52. Adjacent to the inner abutment surface 53 the sill is provided with a gutter 55 to receive condensation from a window received in the sub-frame and the gutter may have apertures if desired to conduct condensation into the cavity 14 which it overlies. The sill has an inner sill portion 56 which overlies the bricks of the inner skin 13 which define the lower surface of the aperture 20 and this sill portion 56 is overlapped by an inner sill member 57.

The bases 24, 40 and 50 of the jambs, the lintel and the sill respectively define a rectangular aperture to receive a window. This rectangular aperture is surrounded by inner and outer abutment surfaces. Thus there are the inner abutment surfaces 27, 43 and 53 on the jambs lintel, and sill respectively and these lie in the same plane. Similarly there are the outer abutment surfaces 28, 44 and 54 of the jambs the lintel and sill respectively and these also lie in the same plane which is parallel to the plane in which the inner abutment surfaces lie.

A window indicated generally at 58 is received in the aperture defined by the bases 24, 40 and 50. The window shown is double glazed and has inner and outer panes 59 and 60 which are received in a frame 61. The frame 61 has an outer flange 62 and it will be seen that the main body of the window is received within the aperture defined by the bases 24, 40 and 50 while the flange 62 overlaps the outer abutment surfaces 28, 44 and 54. The flange is sealed to these outer abutment surfaces by means of a layer of mastic 63. The window is retained in position in the aperture by means of a plurality of lugs, two of which are indicated generally at 64. The lugs are engaged in the window frame and have portions 65 which, after the window has been inserted in the aperture, are bent over to overlie the inner abutment surfaces 27, 43 and 53. The assembly is finished by means of a T-section sealing strip indicated generally at 66. The cross member 67 of the T overlaps the inner abutment surfaces and the inner surface of the frame 61 while the cross-member 68 of the T extends between the inner part of the frame and the bases 24, 40 and 50 but is cut away, where necessary, to give passage to the lugs 64.

It will be seen that by virtue of the overlap of the flange 62 of the frame of the window with the outer abutment surfaces 28, 44 and 54 of the sub-frame, it is not necessary for the main body of the window-frame to be an accurate fit within the aperture defined by the bases 24, 40 and 50. This means, therefore, that the window and the sub-frames need not be manufactured to such close tolerances as would be the case were there no overlap. The sub-frame has the added advantage, as mentioned above, of providing guidance during building of the cavity wall.

Figure 6:
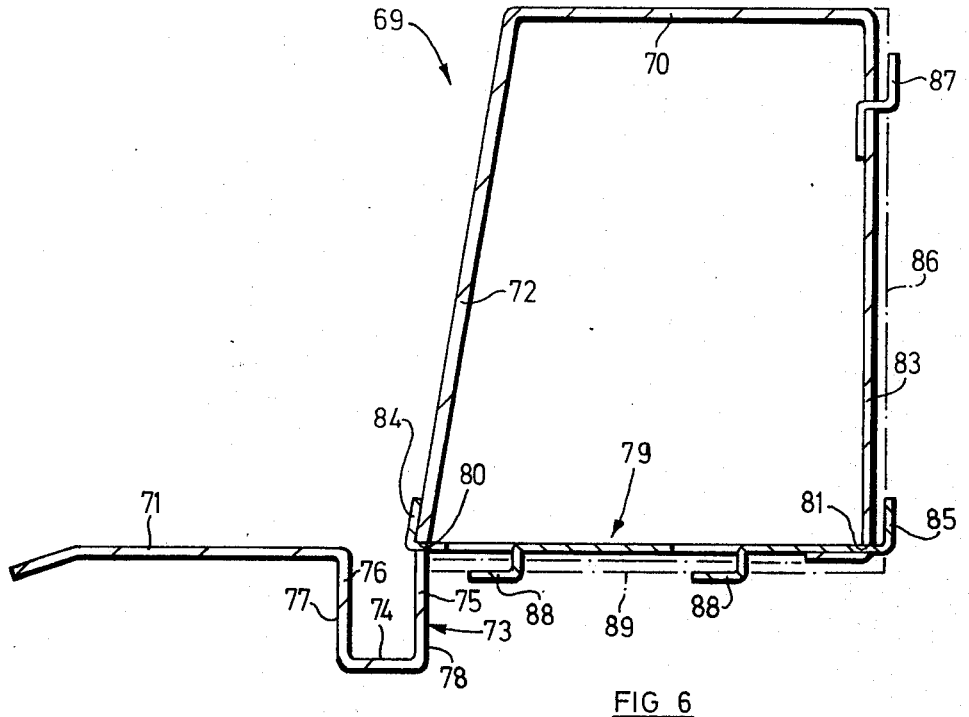
FIG. 6 is a vertical section through a modified form of lintel which may be used in a sub-frame shown in FIGS. 1 to 5.
Figure 7:
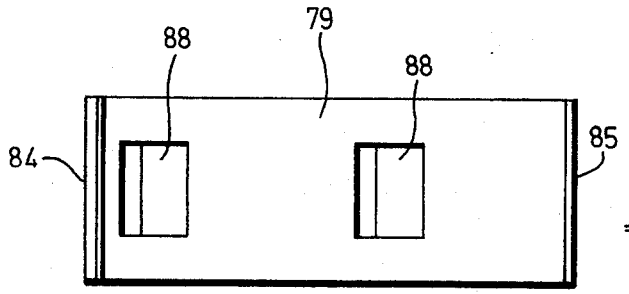
FIG. 7 is a plan view of one of the second elements forming part of the lintel of FIG. 6.

Instead of having the form of lintel shown in FIGS. 1 to 5, the sub-frame can have the form of lintel shown in FIGS. 6 and 7. This lintel is indicated generally at 69 and includes, as before, a Z-shaped element which provides an upper part 70 for supporting the inner skin above the sub-frame and an outer part 71 for supporting the outer skin of the sub-frame. The inner and outer parts 70 are interconnected by an inclined part 72. Between the inclined part 72 and the lower part 71 there is a U-section part indicated at 73 and this has a base 74, an inner side 75 and an outer side 76. In a sub-frame including a lintel of this design the base 74 would define the upper edge of the aperture to receive the window and the outer surface 77 of the outer side 76 would provide an outer abutment surface for being overlapped by the flange on the frame of the window and the inner surface 78 of the inner side 75 would provide an inner abutment surface.

The lintel also includes a plurality of second elements, one of which is indicated at 79 and is shown in plan in FIG. 7. The second element is in the form of a strip of metal and its ends pass through slots 80 and 81 in the inclined parts 72 and a depending flange 83 which is also provided by the Z-shaped elements and extends from the inner edge of the upper part 70. The ends 84 and 85 of the second element are bent up to lie parallel to the inclined parts 72 and the flange 83 and serve to prevent the part 72 and the flange 83 spreading when the lintel is under load. Wire mesh, or expanded metal may be secured to the lintel as indicated at 86 and will be received between the flange 83 and the end 85. It will be appreciated that there will be a number of such hooks 87 and since there are a number of second elements 79 spaced along the lintel there will be a number of extremities 85. Each second element 79 also has hooks 88 formed therein to support mesh 89. The mesh provides an anchorage for plaster in a manner described in relation to the mesh 45 and 46 in FIG. 5. The hooks 88 will be of appropriate size to engage with the mesh or expanded metal.

A sub-frame having a lintel of the construction shown in FIGS. 6 and 7 will be used in the same manner as the lintel described in relation to FIGS. 1 to 5 and will have the same advantages.

I claim:

1. In a building having a cavity wall comprising an inner skin of bricks and an outer skin of bricks; a sub-frame in the wall for supporting a window therein and providing a rectangular aperture to receive the window; the sub-frame comprising a load-bearing lintel, a sill and parallel jambs extending between, and spaced inwardly from the ends of, the lintel and the sill, the lintel, sill and jambs being rigidly interconnected; said aperture being bounded by parts of said lintel, sill and jambs; said parts being generally U-shaped in section in planes perpendicular to the general plane of the window to be recieved in the aperture, the U-sections of said parts being in the form of rectangular channels with the bases of the U-section of the parts defining the edges of the aperture and the limbs of the U-section providing inner and outer abutment surfaces extending away from the centre of the aperture around the whole of the periphery thereof; the jambs having a sectional shape such that, in addition to said channel-section part each jamb has a first flange parallel to the base of the channel and extending from an edge of one side of the channel remote from the base and a second flange extending from the other side of the channel remote from the base at an obtuse included angle with the inner surface of said other side; the lintel having an inner part adapted to support, over the sub-frame, the inner skin of bricks of a cavity wall in which the sub-frame is received; an outer part adapted to support the outer skin of bricks of said wall over the sub-frame; and an inclined part which extends across the cavity and which joins the inner and outer parts, the inner part being spaced upwardly from the outer part; the sub-frame being received in an aperture in said wall so that the inner part of the lintel supports the inner skin of bricks over the sub-frame, the outer part of the lintel supports the outer skin of bricks over the sub-frame with the inclined part of the lintel extending across the cavity and wherein the first flange of each of said jambs overlaps a vertical surface at the side of the aperture in the inner skin and the second flange of each said jamb is received in the cavity against the inner surface of the outer skin and provides a moisture barrier.

2. A sub-frame for supporting a window in a building and providing a rectangular aperture to receive the window, the sub-frame comprising a load-bearing lintel, a sill and parallel jambs extending between, and spaced inwardly from the ends of the lintel and the sill, said lintel, sill and jambs being rigidly interconnected; said aperture being bounded by parts of said lintel, sill and jambs; said parts being generally U-shaped in section in planes perpendicular to the general plane of the window to be received in the aperture, the bases of the U-section of the parts defining the edges of the aperture and the limbs of the U-section providing inner and outer abutment surfaces extending away from the centre of the aperture around the whole of the periphery thereof; said lintel having an inner part adapted to support, over the sub-frame, the inner skin of bricks of a cavity wall in which the sub-frame is received; an outer part adapted to support the outer skin of bricks of said wall over the sub-frame; and an inclined part which extends across the cavity and which joins the inner and outer parts, the inner part being spaced upwardly from the outer part.

3. A sub-frame according to claim 2 wherein the inner, outer and inclined parts of the lintel are provided by a first, Z-shaped, element which also provides a depending flange extending from the inner edge of the inner part, the lintel including a second element extending between the lower end of the depending flange and the outer part and providing said U-section part of the lintel.

4. A sub-frame according to claim 2 wherein the inner, outer and inclined parts of the lintel are provided by a first Z-shaped, element which also provides a depending flange extending from the inner edge of the inner part, the Z-section element also providing, adjacent the inner edge of the outer part, said U-section part of the lintel.

5. A sub-frame according to claim 4 including a plurality of spaced second elements extending between the lower ends of said depending flange and the lower edge of said inclined part.

6. A sub-frame according to claim 5 wherein the extremities of said second elements pass through slots in the depending flange and the inclined part, the extremities having been bent to lie parallel to said flange and said inclined part to prevent spreading thereof under load.

7. A sub-frame according to claim 5 wherein the second elements are provided with hooks to receive mesh to act as an anchor for plaster.

8. In a building having a cavity wall comprising an inner skin of bricks and an outer skin of bricks; a sub-frame in the wall for supporting a window therein and providing a rectangular aperture to receive the window; the sub-frame comprising a load-bearing lintel, a sill and parallel jambs extending between, and spaced inwardly from the ends of, the lintel and the sill, the lintel, sill and jambs being rigidly interconnected; said aperture being bounded by parts of said lintel, sill and jambs; said parts being generally U-shaped in sectio in planes perpendicular to the general plane of the window to be received in the aperture, the U-sections of said parts being in the form of rectangular channels with the bases of the U-section of the parts defining the edges of the aperture and the limbs of the U-section providing inner and outer abutment surfaces extending away from the centre of the aperture around the whole of the periphery thereof; the lintel having an inner part adapted to support, over the sub-frame, the inner skin of bricks of a cavity wall in which the sub-frame is received; an outer part adapted to support the outer skin of bricks of said wall over the sub-frame; and an inclined part which extends across the cavity and which joins the inner and outer parts; the inner part being spaced upwardly from the outer part; the sub-frame being received in an aperture in said wall so that the inner part of the lintel supports the inner skin of bricks over the sub-frame, the outer part of the lintel supports the outer skin of bricks over the sub-frame and the inclined part of the lintel extends across the cavity.

* * * * *